US007008261B2

(12) United States Patent
Xue et al.

(10) Patent No.: US 7,008,261 B2
(45) Date of Patent: Mar. 7, 2006

(54) STACKED ELECTRICAL CONNECTOR ASSEMBLY

(75) Inventors: Zhenglan Xue, Kunsan (CN); Jinkui Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 367 days.

(21) Appl. No.: 10/668,880

(22) Filed: Sep. 22, 2003

(65) Prior Publication Data

US 2004/0248464 A1 Dec. 9, 2004

(30) Foreign Application Priority Data

Jun. 6, 2003 (TW) ..... 92210429 U

(51) Int. Cl.
*H01R 13/66* (2006.01)

(52) U.S. Cl. ..... 439/541.5; 439/540.1

(58) Field of Classification Search ..... 439/541.5, 439/540.1, 607–609, 79, 701, 108; 200/51.1, 200/51.12

See application file for complete search history.

(56) References Cited

U.S. PATENT DOCUMENTS 4,695,116 A 9/1987 Bailey et al.
5,613,880 A 3/1997 Wang
5,709,554 A 1/1998 Savage, Jr.
6,068,520 A * 5/2000 Winings et al. ..... 439/676
6,116,959 A 9/2000 Taylor
6,227,905 B1 5/2001 Tsai et al.
6,234,833 B1 * 5/2001 Tsai et al. ..... 439/541.5
6,234,834 B1 * 5/2001 Tsai et al. ..... 439/541.5

* cited by examiner

*Primary Examiner*—Alexander Gilman
(74) *Attorney, Agent, or Firm*—Wei Te Chung

(57) ABSTRACT

An electrical connector assembly (1) includes an insulating housing (11), a number of mating ports (17), a first terminal group (12), a second terminal group (13) and a third terminal group (14). The insulating housing defines a number of receiving spaces (111) alternately arranged. A number of first, second and third slots (112,114,113) are respectively defined in the housing and communicate with corresponding cavities. The first terminal group comprises a plurality of terminal units each comprising a pair of contacting portions (124) exposed into the receiving spaces and a number of tail portions respectively received in the third slots. The second terminal group is received in the second slots. The third terminal group is received in the third slots and electrically connects with the tail portions of the first terminal group.

20 Claims, 6 Drawing Sheets

STACKED ELECTRICAL CONNECTOR ASSEMBLY

BACKGROUND OF THE INVENTION

1. Field of the Invention

The present invention generally relates to an electrical connector assembly, and particularly to a stacked electrical connector assembly provided with a common housing.

2. Description of Related Art

A computer is required to provide connectors at input/output ports, which are usually mounted on a main printed circuit board (PCB) thereof, to mate with corresponding complementary connectors of peripheral devices for signal transmission therebetween. In order to sufficiently utilize limited area of the main PCB, the electrical connectors are usually arranged in a stacked manner. There exists in the art a stacked jack socket connector assembly mounted on a printed circuit board for transmitting audio signals from jack plugs to corresponding circuitries on the printed circuit board. Such stacked jack socket connector assembly is disclosed in U.S. Pat. Nos. 4,695,116, 5,709,554 and 6,116,959. Each of the stacked jack socket connector assemblies disclosed in the patents mentioned above comprises at least two dielectric housings each defining an axial cavity therein, a plurality of sets of spring contacts respectively received in the housings with spring contacting portions thereof exposed in the cavities of the housings for electrically connecting with jack plugs, and plurality of transition electrically connected with the spring contacts.

Current trend inclines to use more miniaturized components aimed at high integration. The dielectric housings of each stacked jack socket connector assembly mentioned above are separately manufactured and then assembled together. This structure does not accord with the current trend and there still remains room for decreasing the occupied space of such a stacked jack socket connector assembly. A unitary connector assembly having multiple rows and columns of mating ports, either aligned or offset, is desired. Furthermore, each dielectric housing of the stacked jack socket connector assembly is preferable to have a different color from that of other housings for easy to distinguish in use. However, the colored housings are relatively costly.

Hence, an improved stacked electrical connector assembly is highly to overcome the disadvantages of the related art.

BRIEF SUMMARY OF THE INVENTION

Accordingly, it is an object of the present invention to provide a stacked electrical connector assembly having a common housing for minimizing occupied space thereof.

It is another object of the present invention to provide a jack connector which is easy to distinguish in use and is more economical.

In order to achieve the above-mentioned objects, an electrical connector assembly in accordance with the present invention comprises an insulating housing defining a first face and an opposite second face, a plurality of mating ports, a first terminal group, a second terminal group and a third terminal group. The insulating housing comprises a plurality of receiving spaces alternately extending from the second face toward the first face thereof. A plurality of first, second and third slots are respectively defined in the housing and communicate with corresponding receiving spaces. The mating ports are respectively assembled to the housing and align with the receiving spaces. The first terminal group is assembled to the insulating housing and comprises a plurality of terminals received in the receiving spaces. Each terminal comprises a pair of contacting portions adapted for electrically connecting with a complementary connector and a plurality of tail portions respectively received in the third slots. The second terminal group is received in the second slots and comprises a plurality of arms respectively extending into the mating ports of the housing. The third terminal group is received in the third slots and electrically connects with the tail portions of the first terminal group.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
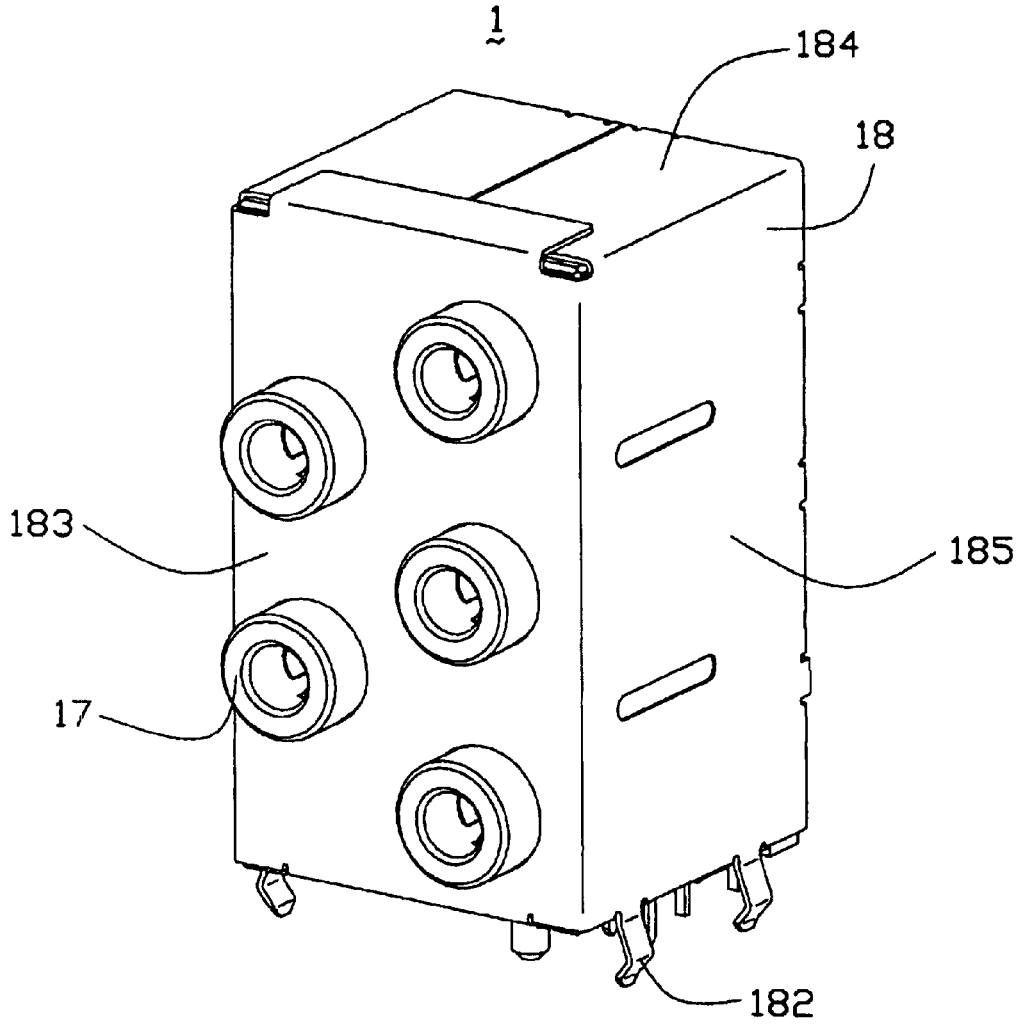
FIG. 1 is an assembled view of an electrical connector assembly in accordance with the present invention.

Reference will now be made to the drawing figures to describe the present invention in detail.

Figure 2:
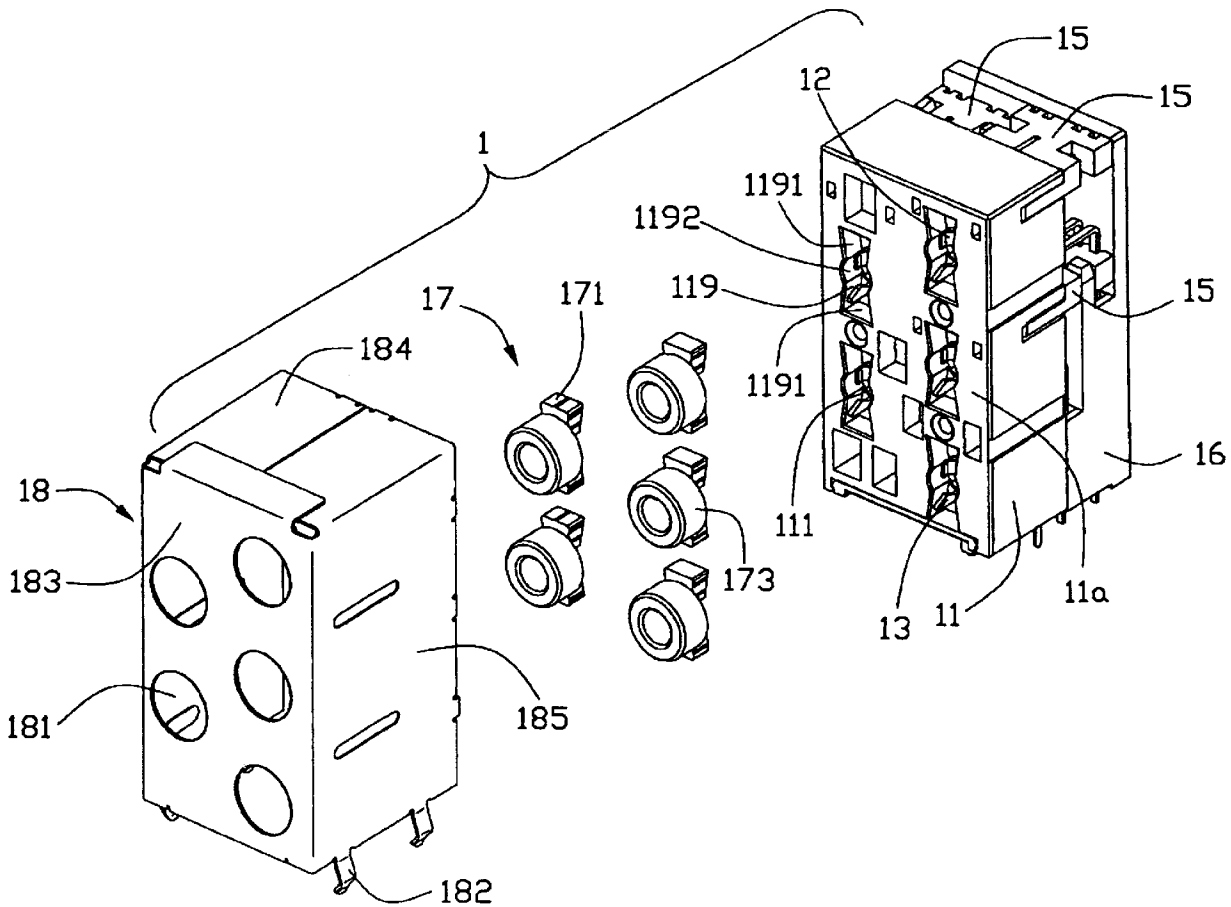
FIG. 2 is a partially exploded, perspective view of FIG. 1.
Figure 3:
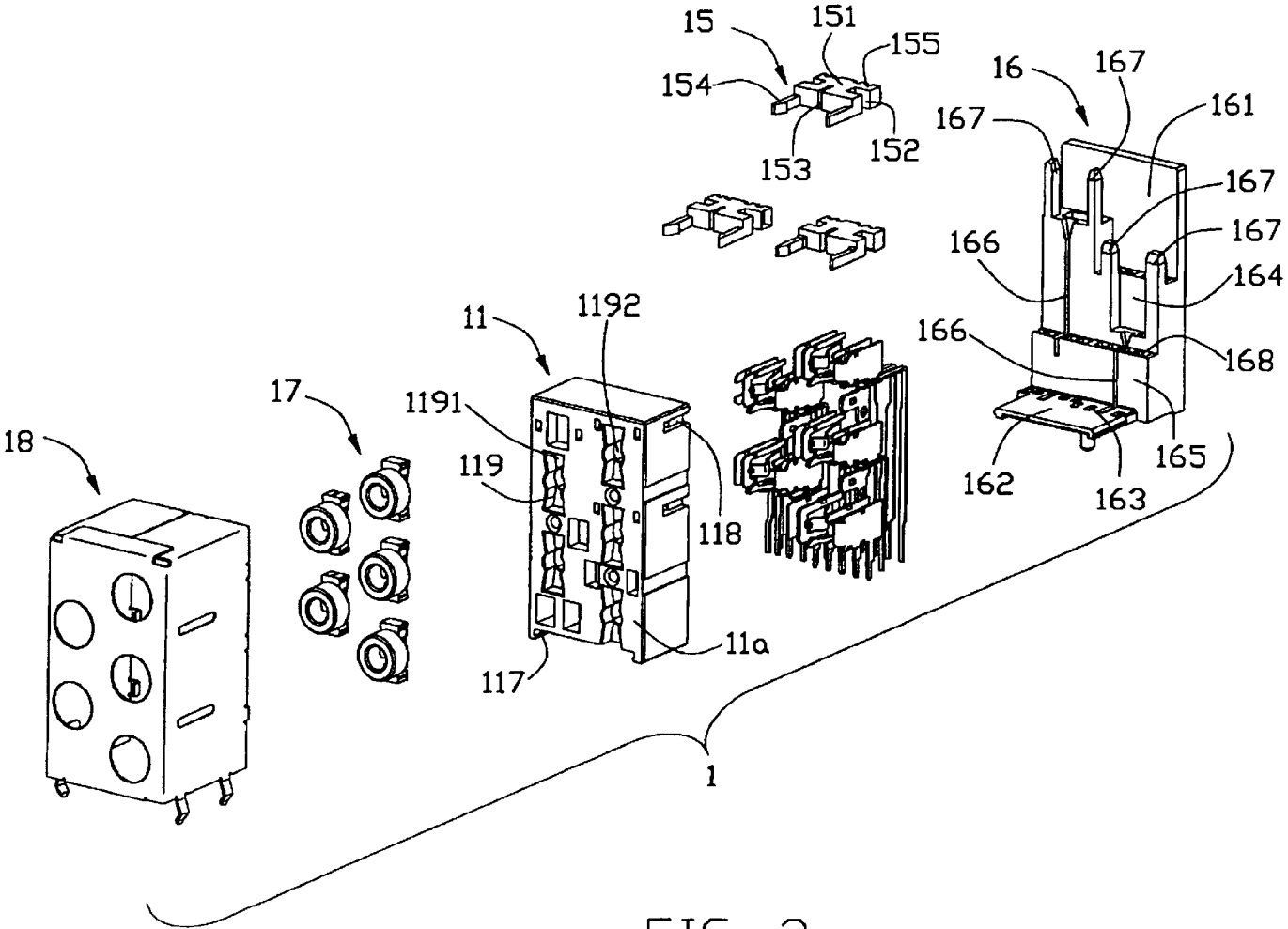
FIG. 3 is a partially exploded, perspective view of FIG. 2.
Figure 4:
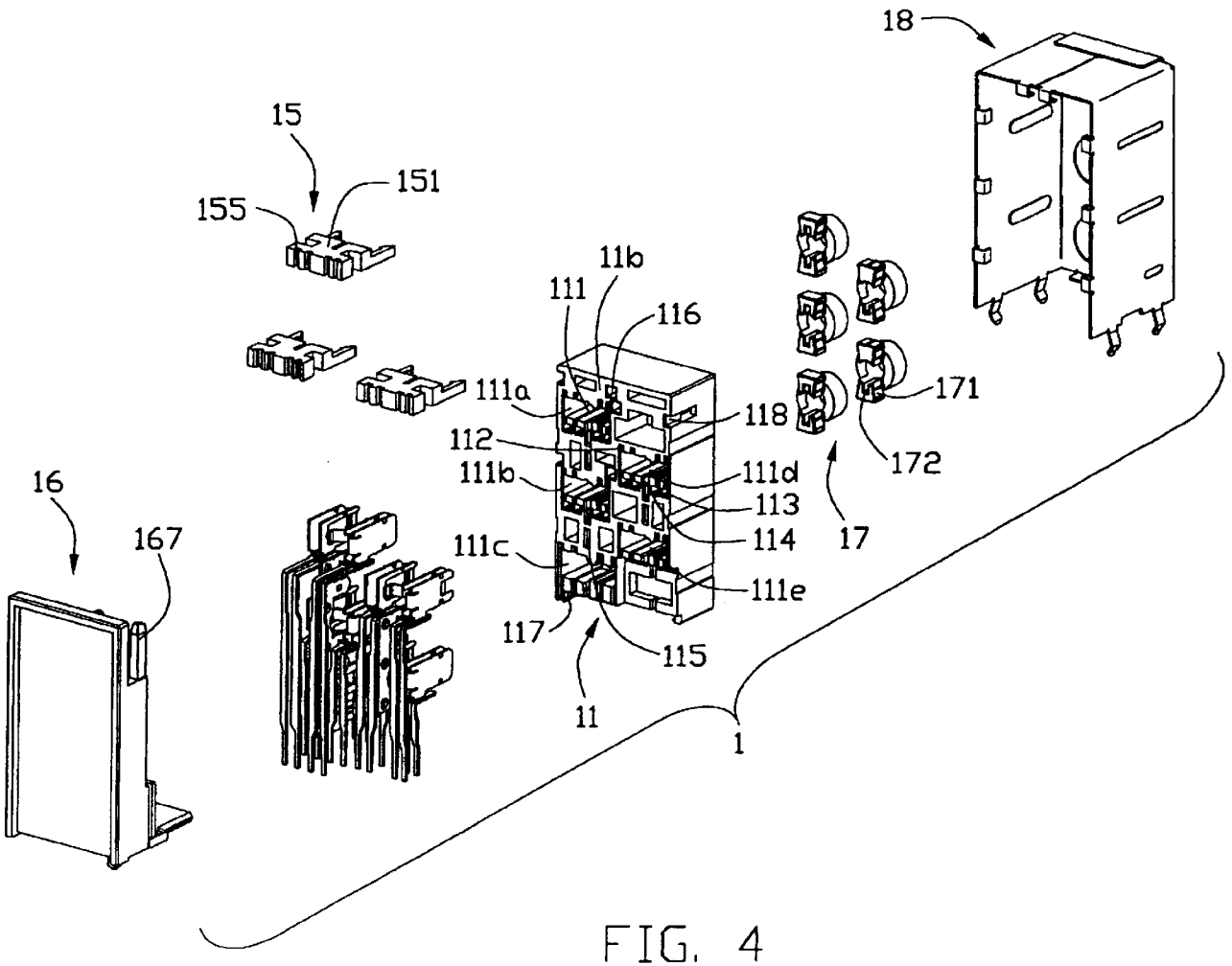
FIG. 4 is a view similar to FIG. 3, but taken from a different aspect.

With reference to FIGS. 1 and 2, and in conjunction with FIGS. 3 and 4, an electrical connector assembly 1 in accordance with the present invention is a stacked audio socket connector assembly and comprises an insulating housing 11, a terminal module comprising a first terminal group 12, a second terminal group 13 and a third terminal group 14 respectively received in the insulating housing 11, a spacer 16, a plurality of retaining blocks 15, a plurality of mating ports 17 and a metal shield 18.

Referring to FIGS. 3 and 4, the insulating housing 11 is generally in a rectangular shape. The housing 11 comprises a first face 11*a* and an opposite second face 11*b*. Five cavities 119 are defined rearwardly from the first face 11*a* of the housing 11 and are alternately arranged in a first array and a second array parallel to each other and along a direction parallel to the first face 11*a* of the housing 11. Each cavity 119 comprises a cylindrical hole 1192 and a pair of trapeziform spaces 1191 respectively communicating with the cylindrical hole 1192. Five receiving spaces 111 are defined forwardly from the second face 11*b* of the housing 11 and respectively communicate with the cavities 119. The five receiving spaces 111 are respectively designated as 111*a*, 111*b*, 111*c*, 111*d* and 111*e*. A first slot 112, a second slot 114 and s third slot 113 are respectively defined forwardly from the second face 11*b* of the housing 11 and communicate a corresponding receiving space 111. The slots 112, 113, 114 are respectively located above the receiving space 111, below the receiving space 111, and in a middle of a bottom edge of the receiving space 111. A plurality of side apertures 118 is defined in opposite sides of the insulating housing 11. A plurality of positioning holes 116 is defined forwardly from the second face 11*b* of the housing 11 and is respectively aligning with the side apertures 118 along a right-to-left direction of the housing 11. A plurality of slits 115 is defined between every two neighboring receiving spaces 111. A recess is defined in a bottom surface of the insulating housing 11 to form a pair of latching edges 117 respectively adjacent to opposite sides of the housing 11.

Figure 5:
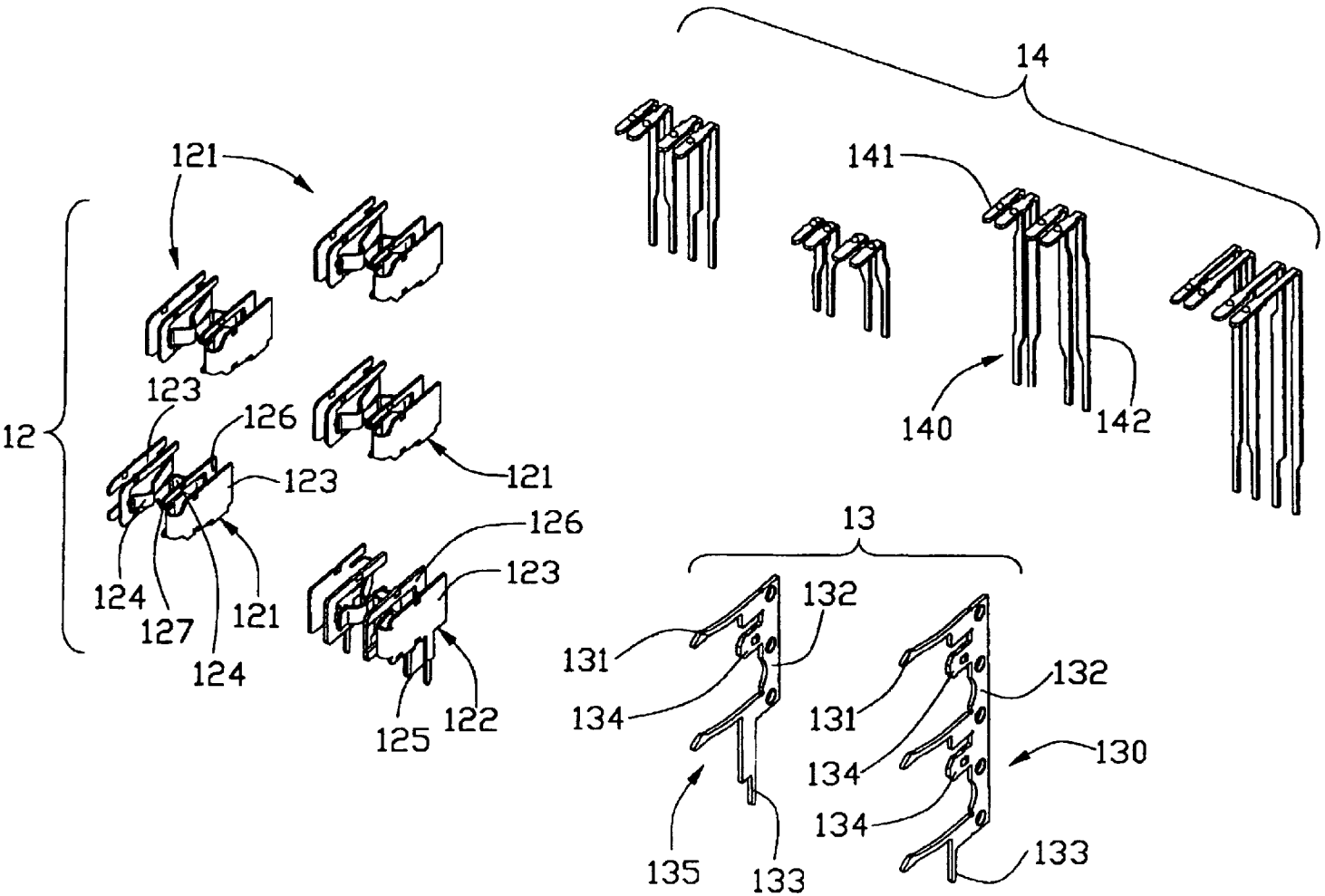
FIG. 5 is a perspective, exploded view of a terminal module shown in FIG. 3.
Figure 6:
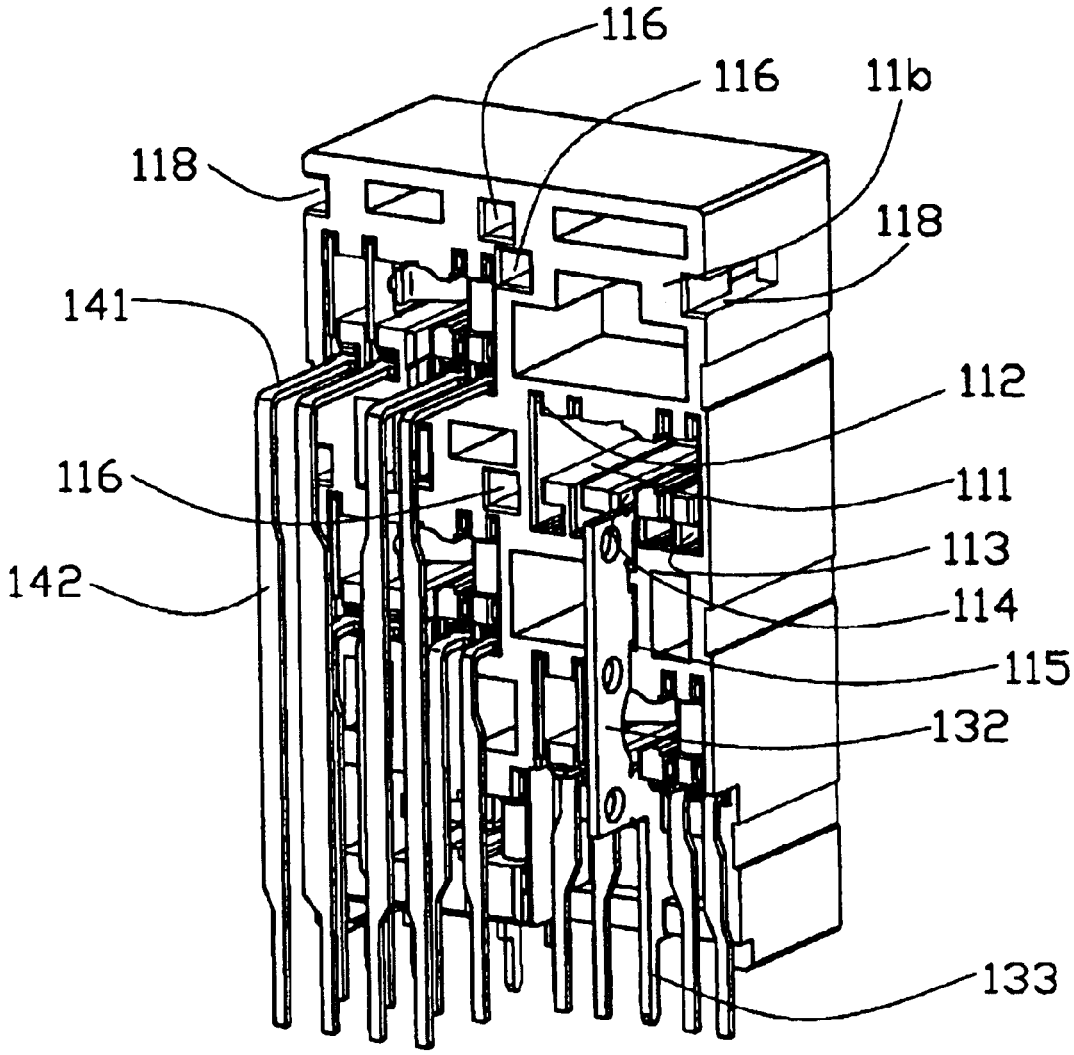
FIG. 6 is a partially assembled view of FIG. 4 with a spacer and a metal shield of the electrical connector assembly removed for simplicity.

Referring to FIG. 5, the first terminal group 12 comprises five signal terminal units, namely four first terminal units 121 and one second terminal unit 122. Each first terminal unit 121 consists of two pairs of halves oriented 180 degrees relative to each other. Each pair of halves comprises a first board portion 123, a second board portion 126 parallel to the first board portion 123, a contacting portion 124 curly extending from the first board portion 123 toward the second board portion 126, and a plurality of tail portions 127 extending vertically from bottom edges of the first and the second board portions 123, 126. The second terminal unit 122 has the substantially same structure as that of the first terminal unit 121 except that tail portions 125 thereof extend straight downwardly from the bottom edges of the first and the second board portions 123, 126.

Continuing to FIG. 5, the second terminal group 13 comprises a first grounding contact 130 and a second grounding contact 135. Each of the first and the second grounding contacts 130, 135 comprise a vertical body strip 132, a plurality of arms 131 horizontally extending forward from the body strip 132 (the first grounding contact 130 comprises three arms 131 while the second grounding contact 135 comprises two arms 131). The arms 131 are spaced apart and parallel to one another. A protrusion 134 extends forwardly from the body strip 42 of the second grounding contact 135 and adjacent to the top arm 131. A pair of protrusions 134 extends forwardly from the body strip 42 of the first grounding contact 130, one adjacent to the top and the other to the middle arms 131, respectively. An insert leg 133 extends downwardly from the bottom arm 131 for soldering to a printed circuit board (not shown).

With reference to FIG. 5, the third terminal group 14 consists of four sets of transition contacts 140 having a similar structure as one another. Each transition contact 140 comprises a mating portion 141 and a terminating portion 142 bending at a right angle from the mating portion 141.

Now referring to FIGS. 2–4, each retaining block 15 comprises a body section 151 and a pair of retaining latches 154 extending forwardly from opposite sides of a front end of the body section 151. The body section 151 defines a through slit 153 in a middle portion of the front end thereof, and the through slit 153 aligns with the slits 115 of the insulating housing 11. A plurality of grooves 155 is defined in a rear end of the body section 151 and a pair of openings 152 is defined in both sides of the body section 151.

Continuing to FIGS. 2–4, the spacer 16 is generally step-shaped and comprises a vertical panel 161 and a base 162 extending forwardly from a bottom end of the panel 161. The vertical panel 161 comprises a first step 165 and a second step 164 higher than the first step 165. A plurality of vertical passages 168 respectively extends through the first and the second steps 165, 164. A pair of through slots 166 is respectively defined in center portions of the first and the second steps 165, 164. The base 162 defines a plurality of rectangular recesses 163 extending therethrough. Each step 165, 164 also forms a pair of posts 167 extending upwardly therefrom.

Each mating port 17 comprises a cylindrical neck 173 and a pair of projections 171 extending oppositely from upper and lower edges of the neck 173. A passageway 172 is defined forwardly from a rear surface of the projection 171 and partially extends into the neck 173.

Referring to FIG. 1, the metal shield 18 is general in a rectangular shape and comprises a front wall 183, a top wall 184 and a pair of opposite side walls 185. Five holes 181 are defined in the front wall 183 and align with the mating ports 17, and a plurality of feet 182 extends downwardly from bottom edges of the pair of side walls 185.

Referring to FIGS. 1–6, in assembly, the first and the second terminal units 121, 122 of the first terminal group 12 are first assembled to the insulating housing 11 from a rear-to-front direction of the housing 11 and respectively received in the receiving spaces 111, the first and the third slots 112, 113. The tail portions 125 of the second terminal 122 extend beyond the bottom surface of the housing 11. The first and the second grounding contacts 130, 135 of the second terminal group 13 are then assembled to the housing 11 with the arms 131 thereof being respectively received in the third slots 114 and the protrusions 134 thereof being received in the slits 115 of the housing 11. The insert legs 133 of the grounding contacts 130, 135 extend beyond the bottom surface of the housing 11. The mating portions 141 of the four sets of transition contacts 140 of the third terminal group 14 are respectively received in the third slots 113 of the receiving spaces 111 and electrically contact with the tail portions 127 of the first terminal units 121. The terminating portions 142 of the transition contacts 140 extend beyond the bottom surface of the housing 11.

One of the three retaining blocks 15 is assembled to the insulating housing 11 above the receiving space **11*b* with one retaining latch 154 thereof being receiving in a corresponding positioning hole 116 and the other retaining latch 154 thereof being received in a corresponding side aperture 118 aligning with the positioning hole 116. At the same time, an upper portion of the vertical body strip 132 of the first grounding contact 130 is received in the through slit 153 of the retaining block 15. The other two retaining blocks 15 are respectively assembled to the top of the housing 11 and engage with corresponding positioning holes 116 and side apertures 118 of the housing 11**.

The spacer 16 is assembled to the housing 11 from a bottom of the housing 11. The base 162 of the spacer 16 is received in the recess defined in the bottom surface of the housing 11 and is secured by the pair of latching edges 117. The terminating portions 142 of the transition contacts 140 respectively protrude through the vertical passages 168 of the first and the second steps 165, 164 and extend beyond a bottom surface of the spacer 16. The body strips 132 of the second terminal group 13 are respectively received in the through slots 166 of the spacer 16. The posts 167 of the spacer 16 are respectively received in the openings 152 of corresponding retaining blocks 152. Thus, the retaining blocks 15 and the spacer 16 are assembled to the insulating housing 11 reliably and provide perfect positioning function to the second and the third terminal groups 13, 14.

The mating ports 17 are respectively inserted into the cavities 119 from the first face **11*a* of the housing 11. The projections 171 of each mating port 17 are received in the pair of trapeziform spaces 1191, while the cylindrical neck 173 is received in the cylindrical hole 1192 of a corresponding cavity 119. The arms 131 of the second terminal group 13 extend into the passageways 172 of the mating ports 17 for providing better grounding effect to the electrical connector assembly 1. The metal shield 18 is finally assembled to the insulating housing 11 along the front-to-rear direction and encloses the housing 11. The cylindrical necks 173** protrude through corresponding holes 181 and are exposed outside the metal shield 18.

It is noted that since the electrical connector assembly 1 provides a common housing 11 for the terminal groups 12, 13, 14, the occupied space of the electrical connector assembly 1 on the printed circuit board is apparently decreased. The alternately arranged structure of the cavities 119 is also helpful to minimize the occupied space of the electrical connector assembly 1. In addition, since the mating ports 17 are assembled to the housing 11 instead of being integrally formed with the housing 11, each mating port 17 can be dyed with different colors more conveniently than the integral structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprises:

an insulating housing comprising a first face and an opposite second face, the insulating housing comprising a first array of receiving spaces extending from the second face toward the first face thereof and a first array of cavities extending from the first face toward the second face thereof and respectively communicating with the receiving spaces;

a plurality of mating ports assembled to the insulating housing and respectively received in the cavities of the insulating housing;

a first terminal group assembled to the insulating housing and comprising a plurality of terminal units, each terminal unit comprising a contacting portion exposed in a corresponding receiving space and a plurality of tail portions;

a second terminal group assembled to the insulating housing and comprising a plurality of arms respectively extending into the receiving spaces of the housing; and a third terminal group assembled to the insulating housing and electrically connecting with the tail portions of the first terminal group wherein each cavity of the insulating housing comprises a pair of trapeziform spaces and a cylindrical hole connecting the trapeziform spaces, and wherein each mating port comprises a cylindrical neck received in the cylinMcal hole and a pair of projections respectively received in the pair of trapeziform spaces.

2. The electrical connector assembly as claimed in claim 1, wherein the insulating housing further comprises a second array of receiving spaces parallel to the first array of spaces, and wherein the receiving spaces are arranged alternately.

3. The electrical connector assembly as described in claim 1, wherein each terminal unit of the first terminal group comprises a pair of halves oriented 180 degrees relative to each other, and wherein the insulating housing defines a plurality of first and third slots communicating with a corresponding receiving space thereof to receive each half of the first terminal group.

4. The electrical connector assembly as disclosed in claim 3, wherein each half comprises a first board portion, a second board portion parallel to the first board portion, and wherein the contacting portion curly extends from the first board portion toward the second board portion.

5. The electrical connector assembly as disclosed in claim 4, wherein the insulating housing defines a plurality of second slots communicating with corresponding receiving spaces thereof to receive the arms of the second terminal group.

6. The electrical connector assembly as described in claim 5, wherein the second terminal group comprises a body strip, the arms and an insert leg adapted for connecting to a printed circuit board, and wherein the arms are spaced apart and extend from the body strip.

7. The electrical connector assembly as described in claim 6, wherein the third terminal group comprises a plurality of sets of transition contacts, and wherein each transition contact comprises a mating portion received in a corresponding third slot and electrically connected with a corresponding tail portion of the first terminal group.

8. The electrical connector assembly as described in claim 7, further comprising a spacer defining a plurality of passages therethrough, and wherein the transition contacts of the third terminal group comprise a plurality of terminating portions extending vertically from the mating portions through the passages.

9. The electrical connector assembly as described in claim 8, wherein the spacer is step-shaped and comprises a first step and a second step, and wherein the passages are respectively defined through the first and the second steps.

10. The electrical connector assembly as described in claim 8, wherein the spacer comprises a panel and a base vertically extending from the panel, and wherein the insulating housing forms a pair of latching edges engaging with the base.

11. The electrical connector assembly as described in claim 8, further comprising a plurality of retaining blocks respectively engaging with the insulating housing and the spacer to secure the spacer to the housing.

12. The electrical connector assembly as described in claim 11, wherein each retaining block comprises a body section and a pair of retaining latches extending from the body section and engaging with the housing.

13. The electrical connector assembly as described in claim 12, wherein the body section of the retaining block defines an opening in a side thereof, and wherein the spacer forms a post received in the opening of the retaining block.

14. A multi-port connector assembly comprising:

a unitary insulative housing defining a plurality of cavities arranged in rows and columns in a front portion and a plurality of receiving spaces in a rear portion and in aligned communication with the corresponding cavities in a front-to-back direction, respectively;

said cavities being arranged in at least two columns;

plural groups of signal terminals forwardly inserted into the corresponding receiving spaces, respectively; said groups being similar to one another.

at least two grounding terminals each with arms extending into the corresponding receiving spaces, respectively;

a spacer located behind the housing and defining plural sets of vertical passageways, said plural sets of vertical passageways being arranged in at least two columns corresponding to said at least two columns of the cavities, respectively; and plural sets of transition contacts located between said plural groups of signal terminals and the spacer, said plural sets of transition contacts being arranged in at least two columns corresponding to said at least two columns of the cavities and said at least two columns of vertical passageways, each set of transition contacts defining horizontal sections mechanically and electrically engaged with the corresponding group of signal terminals, respectively, and vertical sections received in and aligned by the corresponding set of vertical passageways, respectively; wherein the horizontal sections of the transition contacts in each individual set are similar with one another, while those in different sets in the same column are different from one another under a condition that the transition contacts located in a higher level have longer horizontal sections than those in a lower level wherein each of said cavities includes a circular hole with at least one fastening opening beside said hole, and a plurality of mating ports respectively assembled into the corresponding cavities, and wherein each of mating ports defines a cylindrical neck received in the hole and at least one fastening projection received in the corresponding fastening opening.

15. The assembly as described in claim 14, wherein said two columns of the vertical passageways are asymmetrically arranged by two side of an imaginary center plane of said housing which divides said cavities into said two columns without overlapping in a vertical direction.

16. The assembly as described in claim 14, further including a plurality of blocks attached to the rear portion of the housing and engaged with different positions of said spacer, wherein said blocks are arranged in at least two columns in compliance with said two columns of the cavities.

17. The assembly as described in claim 14, further including a plurality of mating ports being attached to the front portion of the housing, wherein said mating ports are arranged with at least two columns, and at least one of said mating ports defines a color different from those of others.

18. The assembly as described in claim 17, wherein each of said mating ports includes a projection received in the corresponding cavity and behind a front face of the housing.

19. The assembly as described in claim 14, wherein said spacer defines two spaced vertical slots to receive said two grounding terminals therein, respectively.

20. The assembly as described in claim 19, wherein said two slots are different from each other.

* * * * *